United States Patent [19]

Minella et al.

[11] 4,254,722

[45] Mar. 10, 1981

[54] NEEDLE DRIVING APPARATUS FOR SEWING MACHINES

[75] Inventors: Giancarlo Minella, Milan; Franco Marchesi, Pavia, both of Italy

[73] Assignee: Rockwell-Rimoldi, S.p.A., Milan, Italy

[21] Appl. No.: 145,082

[22] Filed: Apr. 30, 1980

[30] Foreign Application Priority Data

Jul. 18, 1979 [IT] Italy ..... 244445A/78

[51] Int. Cl.[3] ..... D05B 55/14

[52] U.S. Cl. ..... 112/221; 74/103

[58] Field of Search ..... 112/221, 220; 74/99 R, 74/101, 102, 103, 104, 105

[56] References Cited

U.S. PATENT DOCUMENTS

| | | | |
|---|---|---|---|
| 3,645,221 | 2/1972 | Hirayama | 74/104 X |
| 3,745,951 | 7/1973 | Marforio | 112/221 |

*Primary Examiner*—Peter P. Nerbun

[57] ABSTRACT

An apparatus for selectively changing the distance of needle travel in a sewing machine in which the needle is carried by a needle clamp and reciprocated by a crank driven control lever along a pathway defined by a fixed guide bar. One end of the control lever has a lever pivotably connected thereto and the opposite end of this lever is pivotably connected to an eccentrically mounted and selectively positionable pin that protrudes from the machine's housing. Each of the available positions of the pin provide a means for effecting a change in the distance a needle travels during seaming for the purpose of accommodating workpieces of different thicknesses.

4 Claims, 4 Drawing Figures

NEEDLE DRIVING APPARATUS FOR SEWING MACHINES

BACKGROUND OF THE INVENTION

The present invention pertains to an apparatus for driving the needle of a sewing machine of the type having a needle clamp mounted for sliding movement on a needle guide bar that is fixedly supported by the casing or housing of the machine, and which is pivotably connected to one end of a control lever that is pivotably mounted intermediate its ends on a crank forming one end of an oscillatably driven shaft of the machine. The opposite end of the control lever is operatively connected to a pivotable lever element which is pivotably attached to the housing of the sewing machine. Needle driving apparatuses of this type are well known to those conversant in the art and provide a structure which produces a relatively light load on the supporting bearings and the pivoting elements so that their use is considered especially advantageous in sewing machines operating at high speed.

These known driving apparatuses are distinguished by the fact that the needle clamp slides easily and without interference along the needle bar which is fixed and straight, even though the path travelled by said needle-clamp deviates slightly from a straight line movement. In practice the needle clamp travels a path which resembles an elongated letter "S" that is substantially lengthened in an upwardly direction and with the width thereof being approximately 1 hundredth of a millimeter.

Due to the configuration of the needle path, the needle clamp is caused to deviate a few microns in value, relative to the straight path which the needle bar represents. It has been established that this deviation is considerably greater relative to the lower end of the needle path so that the portion of it utilized during the formation of stitches by the needle clamp is in the area adjacent said lower end and whereby its length depends on the dimensional characteristics of the driving apparatus to which the said needle clamp is connected.

During the formation of each stitch, the needle carried by the needle clamp passes through the material to be sewn to a position below the machine's needle plate where in a known matter it cooperates with the machine's loopers so as to effect proper linking of the threads carried by them. To consistently accomplish this, the location at which the needle cooperates with the loopers must always occur at the same level.

Additionally, during the formation of stitches, the needle is raised a sufficient distance to clear the workpiece beneath it so that no interference will be had with projections, crosswise stitching, pleats, etc., which could prevent it running freely.

When sewing very thick materials, the needle's upward travel must be adequately increased to maintain the same working conditions for medium thick or thin materials, and the location at which the needle cooperates with the loopers beneath the needle plate must remain unchanged.

In the known art, the means of adjusting the needle's upward travel relative to differences in thickness of workpiece materials is accomplished by utilizing the movable pivoting element of the above-mentioned control lever in a different location from that for which it was originally intended for the same type of driving apparatus. This obviously means that no change is made in the general dimensions of the above type of driving apparatus. Originally, the movable pivoting element was formed by a pivoting lever of pre-determined length, which was pivoted at its lower end to the end of the control lever most remote from the needle and pivoted at its upper end on the machine housing and so disposed as to be substantially parallel to the needle bar when in its median position. This arrangement of the pivoting lever made it impossible to increase the needle's upward travel by any appreciable amount without reaching the critical area of the path travelled by the needle clamp. In view of this, a mirror inversion of the above pivoting lever was made and mounted to operate with the control lever. Although this arrangement accomplished its intended purpose, it created an imbalance in the driving apparatus for this combination of levers could not perform their intended functions with the smoothness with which the original form of pivoting lever provided.

As is well known, sewing accessories such as chain stitching equipment, separating knives, additional conveyors, etc., are frequently provided in the area of the work surface of the machine rearwardly of the needle, and must be disposed so as not to cause an interference with the workpiece during the seaming operation. This results in a limited amount of area available for the pivoting lever which requires that it be displaced from the plane in which the control lever usually functions. The levers arranged in this manner initiates wear between the coupling pin and the associated seatings of said levers, as well as between the elements forming the fulcrum in the housing for the pivoting lever, and thus prevent the sewing machine from performing as efficiently as is possible. An object of the present invention is that of overcoming the limitations and disadvantages with the known driving apparatuses while maintaining substantially the same dimensional characteristics. The technical problem to be resolved in accomplishing this object is that of subdividing all the possible thicknesses of materials to be sewn into two distinct groups and predetermining the required amount of travel for the needle clamp that is appropriate for each group and which will function by means of a single driving apparatus having a pivoting lever which can be mounted on the machine's housing in a manner whereby it can be selectively positioned in either of two distinct locations each of which is adapted to provide a different length of travel for the needle clamp.

SUMMARY OF THE INVENTION

The device according to the invention provides a driving apparatus for the needle in which the movable pivoting element or pivoting lever is pivotably supported on the housing of the machine by means of an eccentric pin whose eccentricity corresponds at two points diametrically opposite each other and to the point of application of the said movable pivoting element for at least one and respectively one other of the predetermined lengths of travel for the said needle clamp.

A particular advantage of the inventions is that the greatest efficiency of the system is obtained for each of the two lengths of travel that is provided by a single fulcrum pin whose means of selective positioning provides an extremely easy changover from one to the other of the two different length pathways required for the needle clamp.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
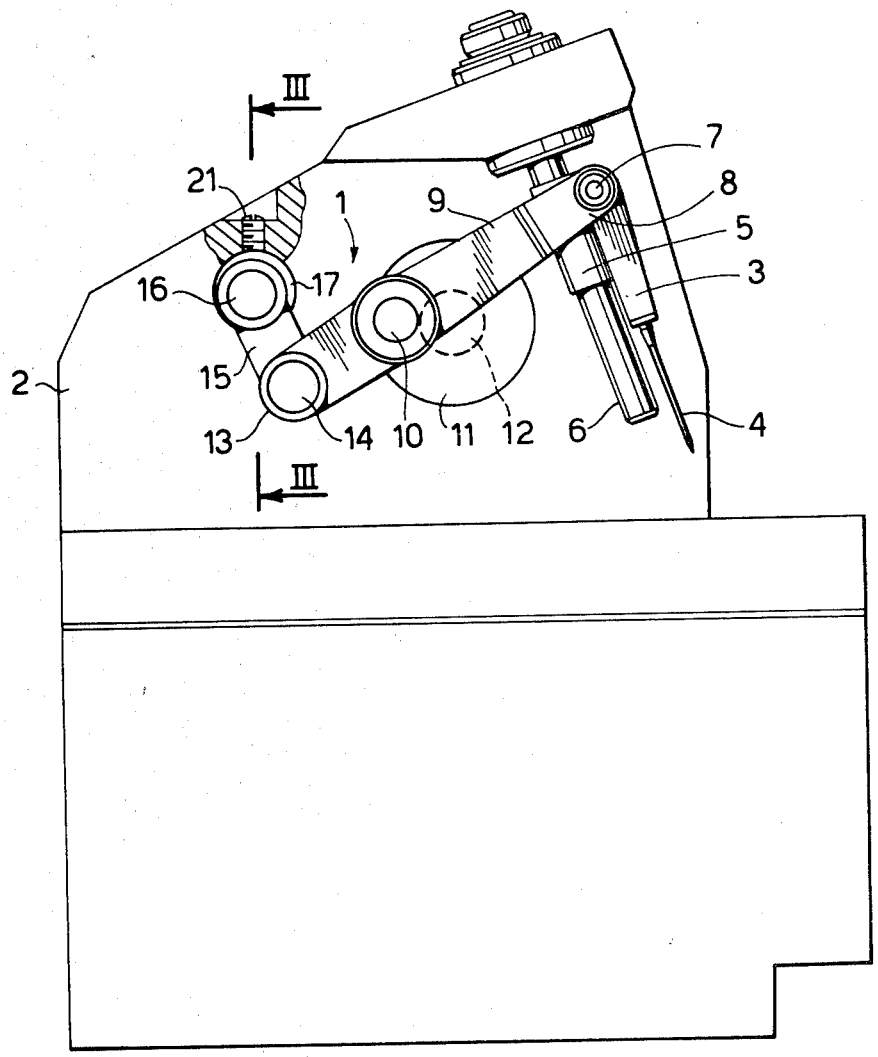
FIG. 1 is a view in side elevation and partically in section of a portion of a sewing machine showing the needle driving apparatus according to the invention applied thereto.

Referring now to FIG. 1, the apparatus for driving the needle according to the invention is identified generally by numeral 1 and is shown supported on the casing or housing 2 of a sewing machine. This needle driving apparatus includes among its various parts a needle clamp 3 having a needle 4 and a sleeve 5 which is mounted to slide freely on a stationary needle bar 6 that is fixed to and extends from the housing 2. The needle clamp 3 and the operatively associated sleeve 5 are interconnected by means of a hinge pin 7 assembled in the end 8 of a control lever 9 which is pivotably supported intermediate its ends on a crankpin 10 of a crank 11. As shown in FIG. 1 crank 11 is disk-shaped and is fixed on or forms an integral end of a control shaft 12 that is supported for oscillating movement in the housing 2. This control shaft 12 is disposed perpendicular with respect to the control lever 9. The end of the control lever 9 opposite end 8 is depicted by numeral 13 and carries a pin 14 which serves to pivotably connect said control lever with the lower end of a movable pivoting element that defines a lever 15. The upper end of the lever 15 is pivotably mounted on a pin 16 which extends from and is supported by the housing 2. The assembled position of the lever 15 on the pin 16 and its association with the control lever 9 is such as to cause said lever 15 to extend in a direction substantially parallel with the needle bar 6 which establishes the path of movement of the needle clamp 3 that will be more fully described hereinafter.

Figure 2:
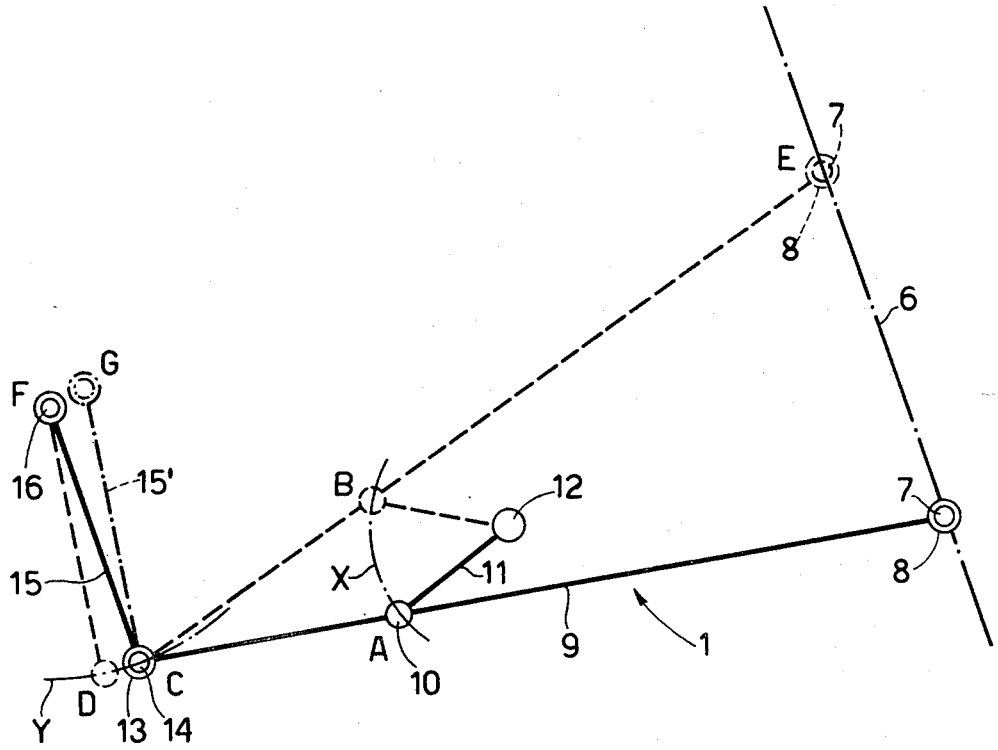
FIG. 2 is a diagrammatic view of the two available operating position for the movable pivoting element.

The needle bar 6 does not force the needle clamp 3 to travel in a straight path, but serves to avoid tilting or moving about of the needle 4 because the end 8 of the control lever 9 and the needle clamp 3 operatively associated therewith both travel a path which is substantially straight. As is known in the sewing art, the path travelled by the needle clamp 3 is not a perfectly straight one, but can be considered to be so within a certain value of the travel of the needle clamp. The needle clamp 3 is reciprocated along that portion of the path corresponding to that which remains substantially straight by the crankpin 10 that is located a distance from the axis of the control shaft 12 which equals about 1/6 of the total length of the control lever 9 (FIG. 2). The crank 11 transmits its oscillations of approximately 50° to the control lever 9 by means of its pin 10 which moves reciprocatingly from the point A to the point B and vice versa along the arc "X" shown in FIG. 2. As the control lever 9 is pivoted on the lever 15, the latter causes said control lever to follow the movements of the crankpin 10 along the arc "X" with a minimum of resistance. During these movements, the end 13 of the control lever 9 moves along the arc "Y" formed by the pin 14 as it moves from the point C to the point D and vice versa in accordance with each movement of the crankpin 10 from A to B or from B to A. As shown in FIG. 2 the selected location of lever 15 on the housing 2 is effective when the crankpin 10 arrives at point B of causing the end 8 of the control lever 9 to be in its uppermost position which is designated by the letter E. With the end 8 arriving in this position the needle clamp 3 has also reached its top dead-center position along with the sleeve 5. Movement of the needle clamp 3 in this manner is effective in causing it to travel a distance of approximately 24 mm. with a minimum of resistance. When a greater distance of travel of the needle clamp 3 is desired, the crank 11 is adjusted to cause it to oscillate a greater number of degrees by adjusting the known internal elements of the machine which are selectively set to control the degrees of oscillation of the control shaft 12.

The invention provides a means which compensates for increasing the oscillating distance of the crank 11 described above by providing a means for selectively changing the operating position of the lever 15 on the housing 2 whereby it can be selectively located in either positions F or G (FIG. 2). In this figure of drawing, numeral 15' represents the location of the lever 15 after its operating position was selectively changed from position F to position G. Position G, which is disposed adjacent and in slightly spaced relation to position F is calculated to tolerable values so as to reduce the difference between the actual path taken by the needle clamp 3 and the straight path represented by the stationary needle bar 6, and especially in connection with the top dead center of the needle clamp. The lowermost point of travel of the needle clamp remains unchanged in both positions of the lever 15 for obvious reasons of timing so that the needle and loopers will cooperate at the same level for proper stitch formation.

Figure 3:
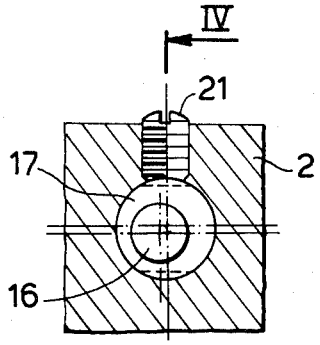
FIG. 3 is a view in side elevation of a portion of FIG. 1 showing further detail of the means for supporting the movable pivoting element.
Figure 4:
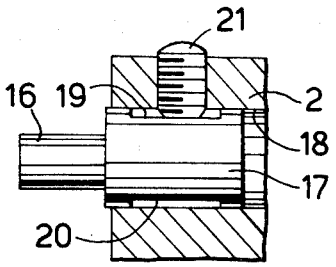
FIG. 4 is a sectional view in side elevation of the means shown in FIG. 3.

To provide the two positions for the pin 16 as location points for the lever 15 on the casing 2, said pin is formed so as to project eccentrically from one end of a cylindrical stud 17 (FIGS. 3 and 4) whereby the axis of the latter extends parallel with but slightly spaced from the axis of said pin. The eccentricity of this pin corresponds at two points, which are disposed diametrically opposite each other, to the two different locations for the lever 15 for selectively effecting a predetermined distance of travel by the needle clamp 3. This cylindrical stud 17 is assembled in a suitable hole or seat 18 formed in the casing 2. This seat 18 is located in a position intermediate the two selectively available locations for the lever 15 which govern the distance the needle clamp 3 is caused to travel during the performance of its intended function.

By selectively rotating the cylindrical stud 17 in its seat 18, the pin 16 can be quickly and easily located in either one of the two desired locations for supporting the lever 15. To simplify this adjustment change and to accurately locate the pin 16, the cylindrical stud 17 is provided with two planar surfaces 19 and 20 formed on the peripheral surface of said cylindrical member in diametric opposed relation. A set screw 21 assembled in a threaded hole in the housing 2 so as to engage one or the other of the planar surfaces 19 and 20 provides a means for fixing the position of pin 16 in the selected location for supporting the lever 15.

The needle driving apparatus according to the invention possesses what is considered a very desirable advantage of providing exceptional smoothness of needle clamp travel in both selectively available operating locations for the lever 15. A further advantage is that of being able to utilize a single housing for machines having needle clamps capable of moving in pathways of different lengths and which do not require control components of different sizes to effect a change from one length of pathway to another.

Additionally, with the eccentric pin 16 forming a fixed element of the cylindrical stud 17 that is adjustably mounted in the housing 2 at a location intermediate the two positions at which it must operate to effect two different lengths of travel of the needle clamp, a means is provided for accurately locating the lever 15 within the range of the particular location desired. By simply rotating the cylindrical stud 17 within its seat 18 it is possible to correct any errors that may occur in the position of the pin 16 relative to the needle bar 6 and to correct the position of the lever 15 with respect to said needle bar.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A needle driving apparatus for a sewing machine of the type having a needle clamp reciprocatably driven by one end of a control lever operatively connected intermediate its ends to an oscillatably driven crank and guided during its reciprocating movement by a needle bar fixed on the housing of the machine, said needle driving apparatus comprising:

(a) a lever (15) pivotably connected to that end of the control lever opposite its connection to the needle clamp;

(b) a pin (16) pivotably connecting the opposite end of said lever (15) to the machine's housing;

(c) means for selectively locating said pin (16) in a plurality of predetermined positions on the housing to effect a different distance of movement of the needle clamp by the control lever in each of said predetermined positions.

2. The structure according to claim 1 wherein said pin (16) is attached to and protrudes from a cylindrical stud (17) assembled in a seat (18) formed in the housing.

3. The structure according to claim 2 wherein the axis of said pin (16) is spaced from and extends in a plane parallel with the axis of said cylindrical stud (17).

4. The structure according to claim 3 wherein said means for selectively locating said pin (16) defines a pair of diametrically opposed planar surfaces (19,20) formed on the peripheral surface of said cylindrical stud (17), and means assembled in the housing for engaging a selected one of said planar surfaces to fix the location of said pin (16).

* * * * *